US006510965B1

(12) United States Patent
Decottignies et al.

(10) Patent No.: US 6,510,965 B1
(45) Date of Patent: Jan. 28, 2003

(54) PRODUCT DISPENSER WITH A FLEXIBLE POUCH

(75) Inventors: Laurent Decottignies, Cergy (FR); Firmin Garcia, Evreux (FR)

(73) Assignee: Airlessystems, Charleval (FR)

( * ) Notice: Subject to any disclaimer, the term of this patent is extended or adjusted under 35 U.S.C. 154(b) by 0 days.

(21) Appl. No.: 09/958,876

(22) PCT Filed: Apr. 19, 2000

(86) PCT No.: PCT/FR00/01019

§ 371 (c)(1),
(2), (4) Date: Jan. 10, 2002

(87) PCT Pub. No.: WO00/64594

PCT Pub. Date: Nov. 2, 2000

(30) Foreign Application Priority Data

Apr. 23, 1999 (FR) ..... 99 05888

(51) Int. Cl.[7] ..... B65D 35/28

(52) U.S. Cl. ..... 222/95; 222/105; 222/156; 222/386.5

(58) Field of Search ..... 222/95, 105, 156, 222/183, 386.5

(56) References Cited

U.S. PATENT DOCUMENTS 5,292,033 A * 3/1994 Gueret ..... 222/95
5,474,212 A * 12/1995 Ichikawa et al. ..... 222/105
5,556,005 A * 9/1996 Banks ..... 222/105
5,730,327 A * 3/1998 Stern ..... 222/105
6,070,763 A * 6/2000 Gueret ..... 222/95
6,142,344 A * 11/2000 Kai ..... 222/183

* cited by examiner

*Primary Examiner*—Joseph A. Kaufman
(74) *Attorney, Agent, or Firm*—Sughrue Mion, PLLC

(57) ABSTRACT

A fluid dispenser including: a flexible pouch (3) containing fluid and provided with an opening (31); a dispensing member (5) such as a pump for drawing off fluid contained in the flexible pouch through the opening; a shell (1) surrounding the pouch (3) and provided with an opening (13) that coincides with the opening (31) of the flexible pouch, the shell (1) being made in two portions (11, 12) connected together along a connection line (14) passing through the opening (13) in the shell so that each shell portion (111, 121) forms a portion of the opening in the shell; a pouch support (2) to which the opening (31) in the flexible pouch (3) is fixed, the support being held in position between the two shell portions (11, 12) at the opening (13) in the shell; and a fixing ring (4) for fixing the dispensing member; the dispenser being characterized in that the fixing ring comprises: a fixing band portion snap-fastened onto the pouch support; and a holding band portion engaged over the opening in the shell to hold the two shell portions together.

9 Claims, 4 Drawing Sheets

PRODUCT DISPENSER WITH A FLEXIBLE POUCH

BACKGROUND OF THE INVENTION

1. Field of the Invention

The present invention relates to a fluid dispenser for dispensing a fluid, said dispenser comprising a flexible pouch containing said fluid, a dispensing member such as pump for drawing off fluid from the flexible pouch, and an advantageously rigid shell in which the flexible pouch is installed. That type of dispenser is particularly applicable to the field of cosmetics, in particular for dispensing creams that are sensitive to exposure to the atmosphere. The use of a flexible pouch associated with an airless pump makes it possible to keep the fluid out of contact from the ambient air, thereby avoiding any oxidation or deterioration.

2. Description of the Background Art

In the prior art, numerous dispensers of that type exist using a flexible pouch and a relatively rigid shell. In all such dispensers, the flexible pouch is fixed either to the rigid shell, or to the pump directly, or else to a sleeve forming a transition between the pouch and the pump, the sleeve often being fixed to the rigid shell. When a transition sleeve is used, it is fixed to the rigid shell by snap-fastening. For that purpose, the rigid shell defines an opening through which the flexible pouch as connected to the sleeve must be inserted. Unfortunately, for that operation, it is necessary to fold the flexible pouch while it is still empty in order to pass it through the opening in the rigid shell. The sleeve can then be snap-fastened to the opening in the rigid shell. It then suffices to fill the flexible pouch with fluid and to fit the airless pump to the transition sleeve. That constitutes the most conventional technique used in the prior art.

In some dispensers of that type known from the prior art, the rigid shell is made up of two portions, but the connection line extends horizontally when the dispenser is held upright. Such a dispenser is described, for example, in Document FR-2 081 244.

Document EP-0 447 687 describes a dispenser provided with a shell in two portions that are connected together via a hinge. By causing the connection line to pass through the opening in the shell, it is possible to dispose the flexible pouch inside one of the two shell portions, and to complete the shell by closing said portion onto the other portion. The two shell portions hold between them a pouch support to which a pouch is bonded. A dispensing head incorporating a pump is fitted to the two shell portions by means of a screw-on ring. For that purpose, the two shell portions together form an opening in the form of a neck whose outside is provided with a thread. By being screwed onto the neck made up of two portions, the ring holds the two shell portions together. At the same time, another effect of the ring being screwed onto the neck is to press the inlet of the pump hermetically onto the pouch support. Therefore, by merely unscrewing the ring, the two shell portions are released and they can then be opened by being pivoted so as to extract the pouch together with its support from them. It should be noted that the ring is not fixed to the pouch support. That is because the dispenser is a refillable dispenser in which the pouch is replaceable. The head must not be fixed to shell and to the pouch support permanently. That is why the fixing technique used is screwing, which is easily reversible. The same applies in Document U.S. Pat. No. 5,474,212 in which the dispensing head is screwed onto the pouch support, the two hinged shell portions do not co-operate with the fixing ring so that they can be opened at any time.

Such refillable dispensers, which are used for household cleaning materials, do not offer much protection against tampering because it is very easy to extract the flexible pouch containing the fluid.

SUMMARY OF THE INVENTION

An object of the present invention is to provide a non-refillable dispenser having a flexible pouch to which the fixing ring is fixed permanently.

To this end, the present invention provides a fluid dispenser comprising:

- a flexible pouch containing said fluid and provided with an opening;
- a dispensing member such as a pump for drawing off fluid contained in the flexible pouch through said opening;
- a shell surrounding said pouch and provided with an opening that coincides with the opening of the flexible pouch, said shell being made in two portions connected together along a connection line passing through the opening in said shell so that each shell portion forms a portion of the opening in the shell;
- a pouch support to which the opening in the flexible pouch is fixed, said support being held in position between the two shell portions at the opening in the shell; and
- a fixing ring for fixing the dispensing member;

the fixing ring comprising:

- a fixing band portion snap-fastened onto the pouch support; and
- a holding band portion engaged over the opening in the shell to hold the two shell portions together.

By snap-fastening the ring to the pouch support and by simultaneously locking the two shell portions together, it is impossible then to open the shell to extract the flexible pouch therefrom. The dispenser cannot be taken apart because it is not disassemblable. Unlike screwing, snap-fastening is permanent. There are therefore no equivalents in this application.

Advantageously, the two shell portions are provided with assembly means situated on the side opposite from the opening. Preferably, the assembly means comprise two snap-fastening systems of the male-female type, each shell portion forming a male connector and a female connector that serve to co-operate respectively with a female connector and with a male connector formed by the other shell portion. Advantageously, the two portions form two identical half-shells.

Furthermore, to facilitate assembling together the two shell portions, the shell portions are provided, at their connection line, with alignment and centering means for guaranteeing that the two shell portions are connected together in proper alignment.

In an original embodiment, at least one portion of the shell is provided with a window via which the flexible pouch is visible. When both portions are provided with respective windows, the shell is in the form of a frame surrounding the flexible pouch.

The invention is described more fully below with reference to the accompanying drawings giving an embodiment of the present invention by way of example.

DETAILED DESCRIPTION OF THE INVENTION

Figure 1:
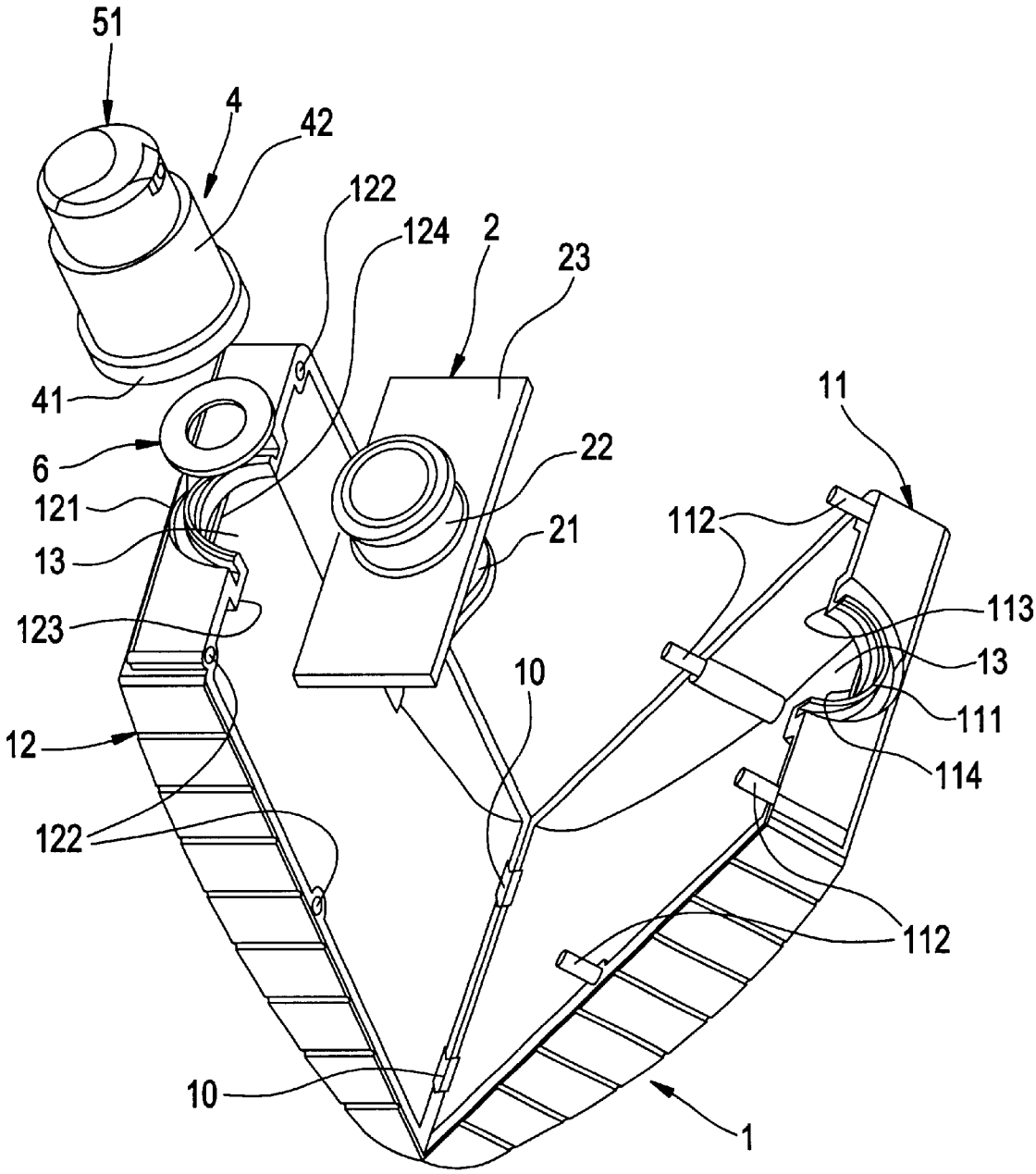
FIG. 1 is an exploded perspective view of a fluid dispenser of the invention, with the flexible pouch not being shown for reasons of clarity.

A fluid dispenser of the invention comprises three essential component elements, namely a flexible pouch 3 (FIG. 4) containing the fluid, an "airless" pump 5 underlying a push-button 51, a shell 1 surrounding the flexible pouch 3, and a fixing ring 4 serving to fix the pump to the pouch.

The particular design of the pump 5 is not essential for the present invention. However, it is preferable and even almost necessary for the pump to be of the airless type in order to take advantage of the resilient properties of the flexible pouch 3 that allow its capacity to decrease as the fluid is dispensed, thereby preventing the fluid contained in it from coming into contact with the ambient air. The internal structure of the pump is therefore not described.

The flexible pouch 3 is preferably made up of two laminated sheets bonded together in sealed manner except at an opening 31 serving to be fixed advantageously by heat-sealing either directly to the body of the pump 5 or to a pouch support 2 as shown in the figures. The detailed structure of the support and its function are given below.

The shell 1 of the invention is made in two portions 11 and 12 which, once they are assembled together, share a connection line which extends in a vertical plane when the dispenser is held upright. The shell 1, which may be substantially rigid, has an opening 13 at its top end, through which opening the pump 5 is coupled to the flexible pouch 3 installed inside the shell 1. According to a particularly advantageous characteristic, the connection line along which the two portions 11 and 12 of the shell 1 are connected together extends through said opening 13 as can be seen in FIG. 1. At the opening 13, each shell portion 11, 12 defines a collar portion 111, 121 which, once the portions are assembled together, constitute a complete cylindrical collar. These collar portions 111, 121 project upwards from flanges 113, 123 which serve in combination with additional flanges 114, 124 to form a fixing recess for the support 2 as explained below. The two shell portions 11, 12 may be made separately, e.g. of molded plastic, and then assembled together. The two shell portions 11 and 12 may also be interconnected via a hinge 10, e.g. at their edge opposite from the opening 13, as shown in FIG. 1. In this embodiment, the two shell portions 11 and 12 are integrally molded together and merely interconnected by bridges of material 10 of thinner thickness that serve as hinges. Thus, the entire shell 1 can be molded in a single operation. Regardless of whether the two shell portions 11 and 12 are interconnected or separate, it is possible to provide alignment and centering means 111, 112 along their common connection line 14, the alignment and centering means being in the form of pegs 112 that are inserted into holes 122 formed in the other shell portion. Thus, it is guaranteed that the two shell portions 11 and 12 are connected together in proper alignment. Simultaneously, it is guaranteed that the opening 13 is formed properly by the two collars 111 and 121 of the two shells 11 and 12.

As mentioned above, the flexible pouch 3 may be bonded directly onto the body of the pump 5. In which case, it is possible to consider having a pump body that defines a connection sleeve to which the opening 31 in the flexible pouch is bonded. The pump 5 and its associated pouch 3 can then be held merely by closing the two shell portions 11 and 12 onto the body of the pump so as to hold it in the opening 13. For example, final closure of the shell 1 may be achieved by bonding at a few spots along its connection line 14. This version constitutes an alternative embodiment.

Figure 2:
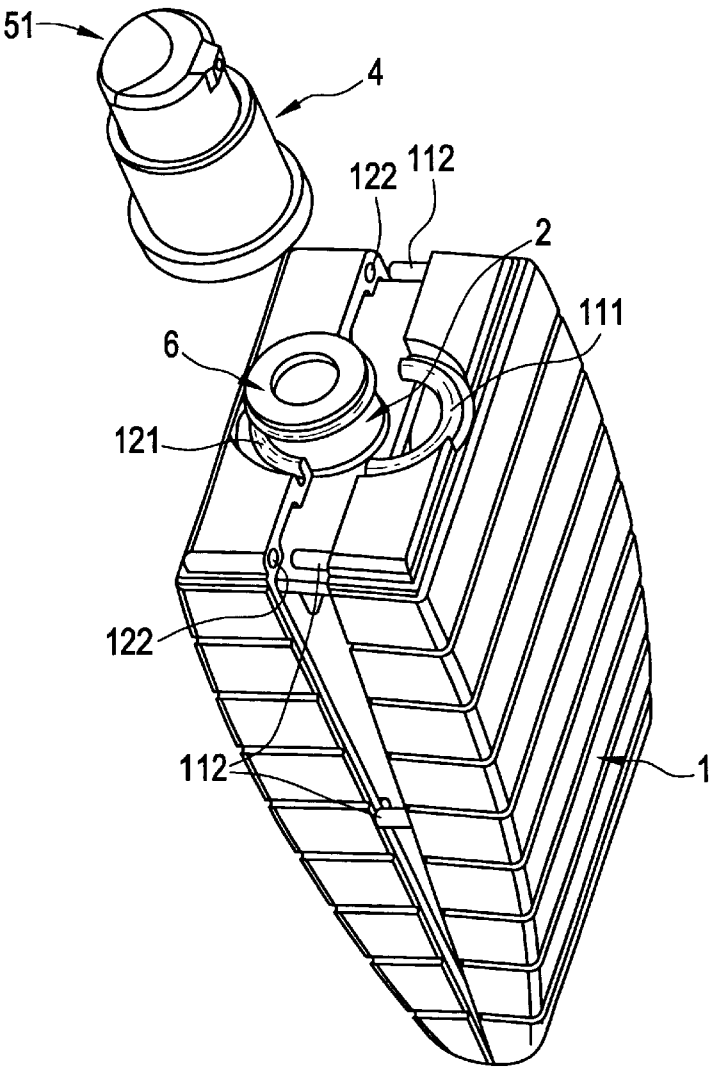
FIG. 2 is a perspective view while the dispenser of FIG. 1 is being assembled.
Figure 4:
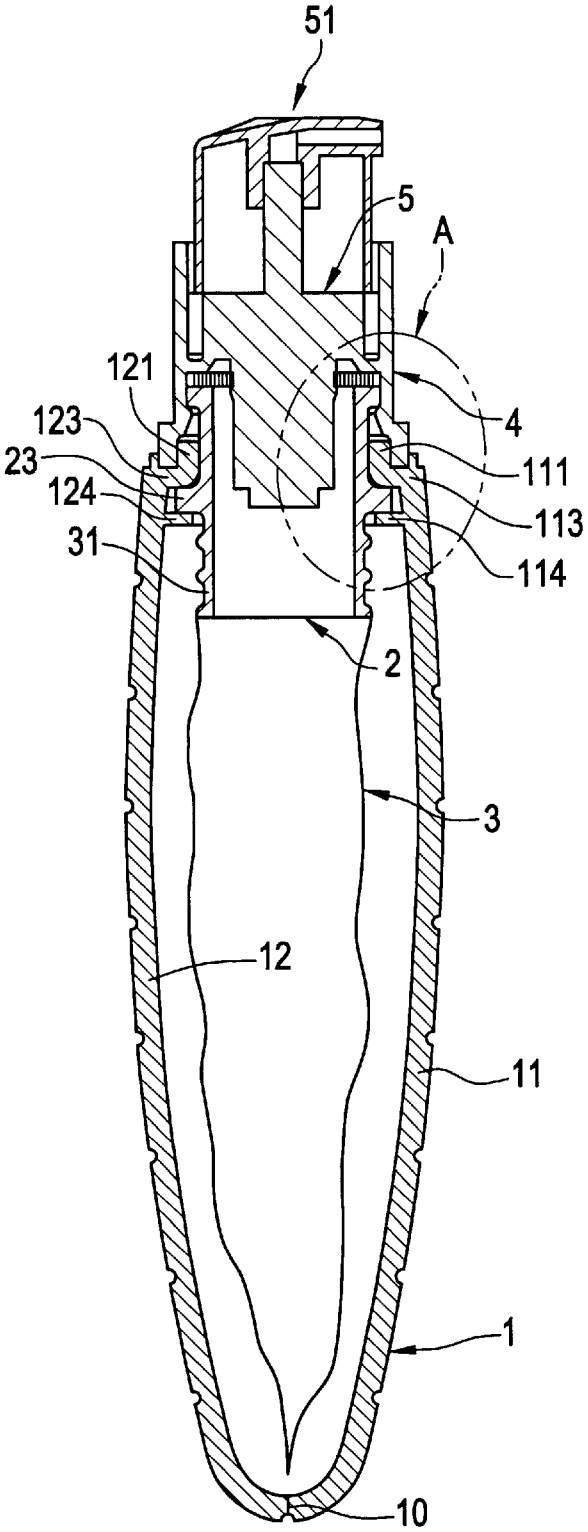
FIG. 4 is a vertical section view through the fluid dispenser of FIGS. 1 to 3.

However, in the examples used to illustrate the present invention, a pouch support 2 is used that makes it possible to couple the pouch 3 to the pump 5. In this case, the pouch support 2 is wedged in the opening 13 in the two shell portions 11 and 12 as shown in FIGS. 1 and 2. More precisely, the pouch support 2 comprises a connection sleeve 21 to which the opening in the pouch 31 is fixed, e.g. by heat-sealing, a bushing 22 that projects upwards and on which the pump 5 rests, and a plate 23 that extends horizontally around the bushing 22 and the sleeve 21 where they meet. A passageway is defined through the sleeve 21, the plate 23 and the bushing 22 to cause the opening 31 in the flexible pouch 3 and the inlet of the pump 5 to communicate as can be seen in FIG. 4. The plate 23 is used to hold the pouch support 2 on the shell 1. For this purpose, the long side edges of the plate come into engagement in the spaces defined respectively between the two flanges 113 and 114 and between the two flanges 123 and 124, as can be seen in FIG. 4. Once closed, the two half shells 11 and 12, which are substantially identical, hold the pouch support 2 properly between them.

Figure 5:
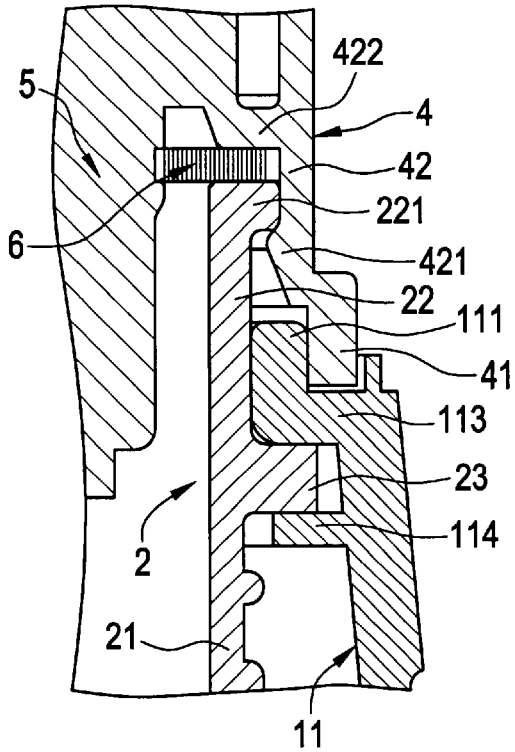
FIG. 5 is an enlarged view of a detail of FIG. 4.

It should be noted that it is particularly easy to put the support 2 as equipped with the flexible pouch 3 in place inside the half-shells 11 and 12 since the opening through which it has to pass is maximized and not limited merely to the opening 13, as it is in the prior art. Once the support 2 and the flexible pouch have been installed in the shell 1, it is necessary merely to fill the pouch with fluid and then to fit the pump 5 on the support 2. For this purpose, the fixing ring 4 is used that makes it possible to snap-fasten the pump 5 permanently on the bushing 22. With reference more particularly to FIG. 5 which is an enlarged view of the various mutual fixing means for fixing together the component elements of the dispenser, it can be seen that the fixing ring 4 is, in this embodiment, made integrally with the body of the pump 5. It is also possible and even more conventional to use a fixing ring 4 that is entirely separate from the pump 5. The fixing ring 4 includes a fixing band portion 42 which defines a snap-fastening recess between a surface 422 and a snap-fastening bead 421 that co-operate with the bushing 22 advantageously with a sealing gasket 6 being interposed. For this purpose, the bushing 22 is provided with an outwardly-projecting rim 221 at its top end. The snap-fastening bead 422 is suitable for coming into engagement under the projecting rim 221 of the bushing 22 by crushing the gasket 6 between the end of the bushing 22 and the abutment surface 422 formed by the fixing band portion 42. When the fixing ring is separate from the pump 5, the pump body 5 defines a collar that is wedged between the surface 422 and the gasket 6. In this way, the pump 5 is fixed securely to the bushing 22 of the pouch support 2.

In addition, in this embodiment, the ring 4 incorporates a holding band portion 41 which makes it possible to lock the two shell portions 11 and 12 together without it being necessary to perform bonding at spots along their connection line 14. This holding band portion 41 comes into engagement on the outside of the collar portions 111, 121 of the two shell portions 11 and 12 that form the opening 13. As a result of the two collar portions 111 and 121 being held together, the two half-shells 11 and 12 are properly locked together.

Thus, a single part, which, what is more, can be made integrally with the pump 5, can be used to fix the pump permanently to the support 2 and to lock the two shell portions 11 and 12 together, thereby enabling the pouch support 2 to be held in the rigid shell 1.

Figure 3:
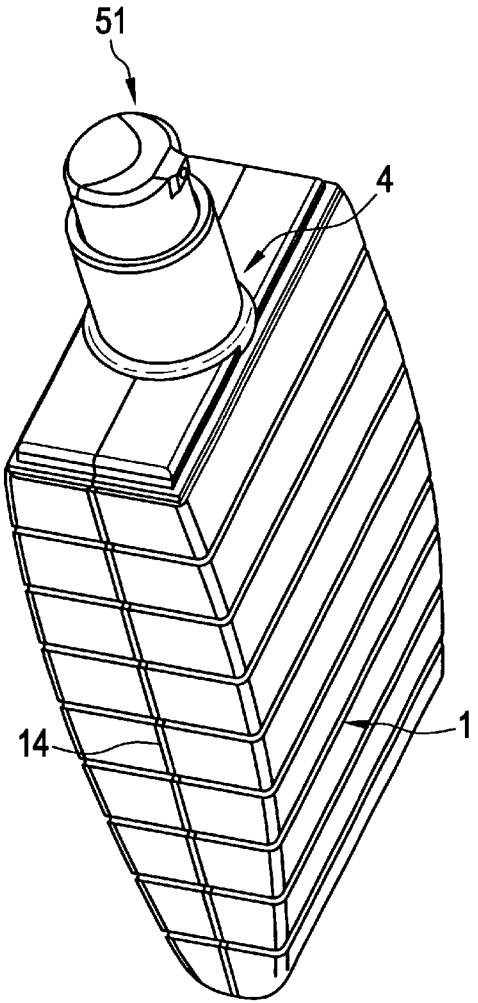
FIG. 3 is a perspective view of the fluid dispenser of FIGS. 1 and 2 in the assembled state.

In the first embodiment shown in FIGS. 1 to 3, once they are closed on each other, the shell portions enclose the flexible pouch which is then no longer visible if the shell is made of an opaque material.

Figure 6:
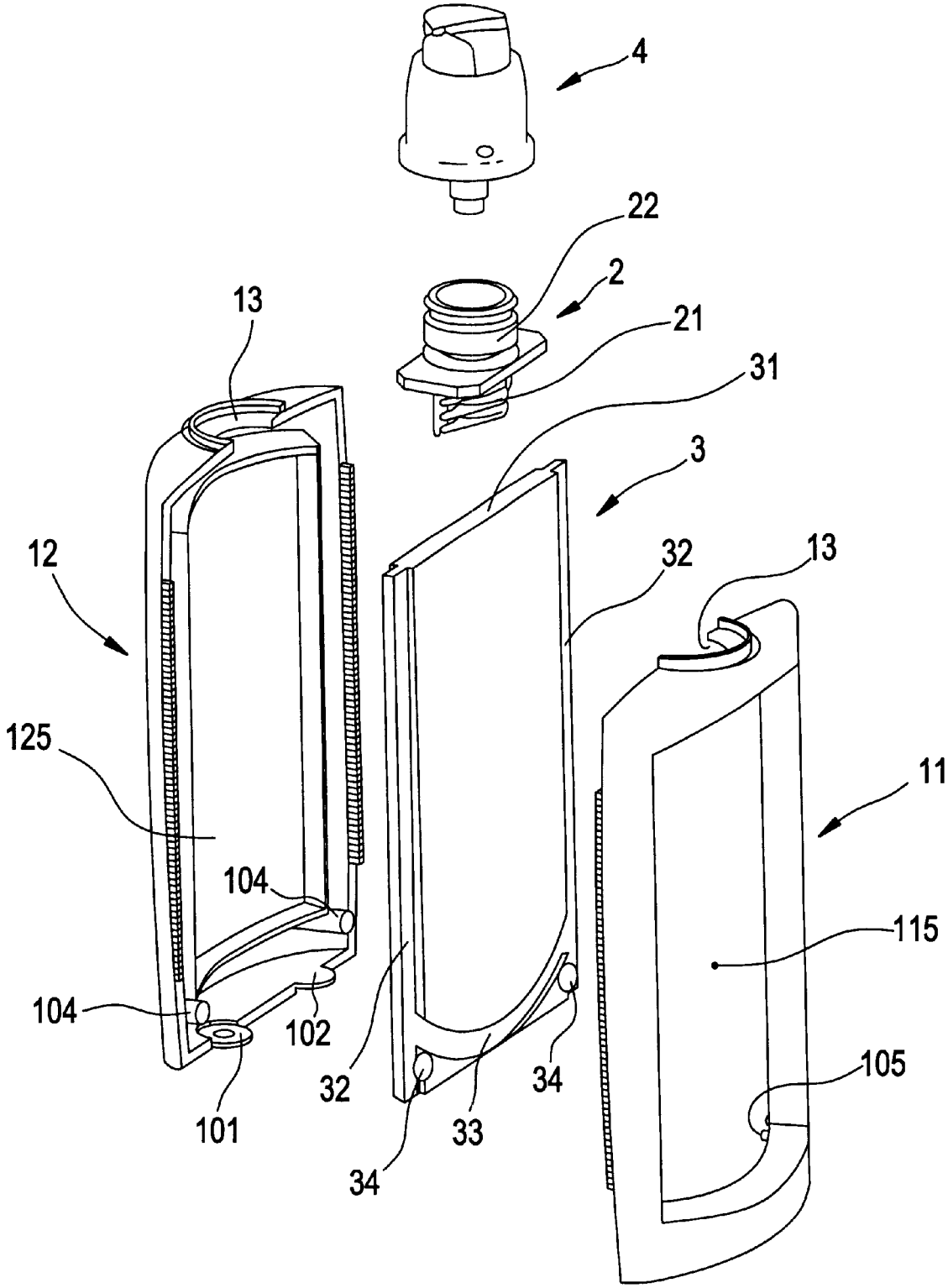
FIG. 6 is an exploded perspective view of a second embodiment of a fluid dispenser.

In the second embodiment shown in FIG. 6, each of the two shell portions forms a frame or yoke defining a wide window 115, 125 inside it, the flexible pouch 3 being visible through each window. One or advantageously both of the shell portions may be provided with such a window. The term "shell" should thus be interpreted in a broad sense in this example.

The shell then merely surrounds or frames the flexible pouch. The pouch may be clamped around its periphery between the two frame portions of the shell. The pouch may be held at its bottom 33 between the two frame portions. For this purpose, the bottom of the pouch is provided with two holes 34, and the frame portions are provided with a system of studs 104, 105 serving to pass through the holes 34 and thereby to hold the pouch. The pouch is held at its bottom 33 only, since, although they are disposed between the frame portions, the side edges 32 are free to move so as to enable the volume of the pouch to vary.

Another feature of this embodiment lies in the assembly technique used to assemble together the two shell portions. While in the other embodiment, the two shell portions are hinged together, in this embodiment, they are assembled together by means of male-female snap-fastening systems 101, 102. For example, each shell portion may form an eye 101 and a lug 102; the lug of a shell portion being suitable for coming into snap-fastening engagement into the eye of the other shell portion and vice versa. The two shell portions can then be exactly identical, and hence savings can be made as regards molding equipment. Such an assembly system or a similar system may naturally be implemented in the preceding embodiment instead of the hinge.

What is claimed is:

1. A fluid dispenser comprising:

a flexible pouch (3) containing a fluid and provided with an opening (31);

a dispensing member (5) for drawing off fluid contained in the flexible pouch through said opening;

a shell (1) surrounding said pouch (3) and provided with an opening (13) that coincides with the opening (31) of the flexible pouch, said shell (1) being made in two portions (11, 12) connected together along a connection line (14) passing through the opening (13) in said shell so that each shell portion (111, 121) forms a portion of the opening in the shell;

a pouch support (2) to which the opening (31) in the flexible pouch (3) is fixed, said support being held in position between the two shell portions (11, 12) at the opening (13) in the shell; and a fixing ring (4) for fixing the dispensing member;

said dispenser being characterized in that the fixing ring comprises:

a fixing band portion snap-fastened onto the pouch support; and a holding band portion engaged over the opening in the shell to hold the two shell portions together.

2. A dispenser according to claim 1, in which the two shell portions (11, 12) are provided with assembly means (101, 102) situated on the side opposite from the opening (13).

3. A dispenser according to claim 2, in which the assembly means comprise two snap-fastening systems (101, 102) of the male-female type, each shell portion forming a male connector (102) and a female connector (101) that serve to co-operate respectively with a female connector (101) and with a male connector (102) formed by the other shell portion.

4. A dispenser according to claim 1, in which the two portions (11, 12) form two identical half-shells.

5. A dispenser according to claim 1, in which, at their connection line (14) the shell portions (11, 12) are provided with alignment and centering means (112, 122) for guaranteeing that the two shell portions are connected together in proper alignment.

6. A dispenser according to claim 1, in which at least one portion (11, 12) of the shell is provided with a window via which the flexible pouch is visible.

7. A dispenser according to claim 6, in which the shell is in the form of a frame surrounding the flexible pouch.

8. The dispenser according to claim 1, wherein said dispensing member is a pump.

9. A fluid dispenser comprising:

a flexible pouch containing a fluid and provided with an opening;

a dispensing member that draws off fluid contained in the flexible pouch through the opening;

a shell surrounding the pouch and provided with an opening that aligns with the opening of the flexible pouch, the shell comprising two shell portions connected together along a connection line passing through the opening in the shell so that each shell portion forms a portion of the opening in the shell;

a pouch support to which the opening in the flexible pouch is fixed, the pouch support held in position between the two shell portions at the opening in the shell; and a fixing ring that fixes the dispensing member, wherein the fixing ring comprises:

a fixing band portion fastened onto the pouch support; and a holding band portion engaged over the opening in the shell to hold the two shell portions together.

* * * * *